US006268775B1

(12) United States Patent
Patti

(10) Patent No.: US 6,268,775 B1
(45) Date of Patent: Jul. 31, 2001

(54) DUAL CAPACITOR OSCILLATOR CIRCUIT

(75) Inventor: Robert S. Patti, Warrenville, IL (US)

(73) Assignee: The Ensign-Bickford Company, Simsbury, CT (US)

( * ) Notice: Subject to any disclaimer, the term of this patent is extended or adjusted under 35 U.S.C. 154(b) by 0 days.

(21) Appl. No.: 09/303,531

(22) Filed: Apr. 30, 1999

Related U.S. Application Data

(62) Division of application No. 08/879,162, filed on Jun. 19, 1997, now Pat. No. 5,912,428.

(51) Int. Cl.[7] ..... H03B 5/24

(52) U.S. Cl. ..... 331/111; 331/143; 102/215; 102/218; 361/251; 307/141.4

(58) Field of Search ..... 331/111, 143, 331/145; 307/141.4, 141.8; 361/249, 251; 102/215, 218

(56) References Cited

U.S. PATENT DOCUMENTS 5,699,024 * 12/1997 Manlove et al. ..... 331/111
5,912,428 * 6/1999 Patti ..... 102/215

* cited by examiner

*Primary Examiner*—Arnold Kinkead

(74) *Attorney, Agent, or Firm*—Libert & Associates; Frederick A. Spaeth

(57) ABSTRACT

An electronic delay circuit (10) useful for the delayed initiation of detonators illustrates several novel features that may be combined, including a novel oscillator (34), a programmable timer circuit (32) and a run control circuit (46). The oscillator (34) generates a clock signal determined by the rate of discharge of a capacitor (34*a*) relative to a reference voltage REF. A second capacitor (34*b*) is charged to a voltage that exceeds REF, and when the first capacitor (34*a*) falls below REF, an internal signal is generated and the capacitors are switched, so that the first capacitor gets charged while the second is discharged. A latch (34*f*) produces clock pulses in response to the internal signals. The programmable timer circuit (32) includes a ripple counter (38) and a program bank (40) that loads a count in the counter upon initialization. Each stage of the counter (38) has separate inputs for set and clear signals, and the program bank (40) has a setting circuit and a clearing circuit for each counter stage. Each clearing circuit generates a signal of fixed duration and each setting circuit can generate a signal of two different durations, one of which exceeds the clear signal. During programming, the set signal of short or long duration is chosen and, in loading the counter, the longer of the set signal or the clear signal determines the state of the counter stage. The run control circuit (46) controls a gate (34*h*) that permits oscillator pulses to increment the counter (38), but closes gate (34*h*) should a temporary loss in power occur thus preventing the timer (32) from being re-initialized.

7 Claims, 12 Drawing Sheets

DUAL CAPACITOR OSCILLATOR CIRCUIT

CROSS REFERENCE TO RELATED APPLICATION

This application is a division of U.S. patent application Ser. No. 08/879,162, filed Jun. 19, 1997 now U.S. Pat. No. 5,912,428, in the name of Robert S. Patti and entitled "ELECTRONIC CIRCUITRY FOR TIMING AND DELAY CIRCUITS".

BACKGROUND OF THE INVENTION

1. Field of the Invention

The present invention pertains to electronic delay detonators and, in particular, to programmable electronic initiation delay detonators.

Electronic detonators are known for use in initiating explosive charges, e.g., for initiating booster charges used in mining and excavation applications. Such detonators are known for their precise delay characteristics relative to more traditional chemical-based delay units.

2. Related Art

U.S. Pat. No. 5,377,592 to Rode et al, dated Jan. 3, 1995, discloses an electronic digital delay unit powered by a pulse of energy generated by a piezoelectric transducer in response to an impulse-type initiation signal. The initiation signal stimulates the piezoelectric transducer to create a charge of electrical energy that is stored in a storage capacitor. Energy is drawn from the storage capacitor to run a timer circuit comprising an oscillator and a counter that counts oscillation pulses from the oscillator to a predetermined count. When the predetermined count is reached, a signal is generated to discharge the remaining energy from the storage capacitor to the electric igniter element, e.g., an exploding bridgewire. The detonator may be equipped with an externally accessible programming interface so that the timer circuit may be programmed with a delay after the detonator is constructed.

U.S. Pat. No. 5,435,248 to Rode et al, dated Jul. 25, 1995, discloses an electronic range digital delay detonator comprising fusible links that are used to perrnanently program a desired function delay into the detonator circuit.

Electronic detonators of the type described in aforesaid U.S. Pat. No. 5,435,248 and U.S. Pat. No. 5,377,592 comprise conventional oscillators and counters.

SUMMARY OF THE INVENTION

The present invention provides several novel features that find utility in electronic delay detonators. One feature of the present invention relates to an oscillator circuit for generating a clock signal comprising a series of clock pulses. The oscillator circuit comprises a reference voltage means for producing a reference voltage. There are at least two capacitors in the oscillator, each capacitor having one of a charged state and a discharged state relative to the reference voltage. A capacitor in the discharged state has a voltage less than the reference voltage and is designated a discharged capacitor, and a capacitor in the charged state has a voltage that exceeds the reference voltage and is designated a charged capacitor. There is a charging means for charging a discharged capacitor to a charged state and a discharging means for discharging a charged capacitor, designated a charged working capacitor, to a discharged state. The oscillator further comprises a comparator for generating an internal signal each time a charged working capacitor becomes a discharged capacitor. There is a switching means for performing a switching function comprising effectively disconnecting a discharged capacitor from the discharging means and connecting it to the charging means, and for effectively disconnecting a charged capacitor from the charging means and connecting it to the discharging means, and a latch for issuing a clock pulse in response to the internal signals. The switching means may be responsive to the latch, for performing the switching function in response to clock pulses issued by the latch.

The invention also relates to a programmable electronic timer circuit for issuing a timer output signal after the expiration of a programmed time delay following the receipt of an electrical initiation signal. The timer circuit comprises a gated oscillator circuit (optionally as described above) for issuing, in response to a clock enable signal, a clock signal comprising a series of clock pulses, and a resetting circuit for generating a power-on RESET signal. The timer also comprises an initializable ripple counter configured to count clock pulses and to produce the timer output signal when a predetermined count is reached. The ripple counter comprises a plurality of sequential counter stages each capable of having either one of a set state and a clear state and comprising a set input by which the state of the counter stage can be set and a clear input by which the state of the counter stage can be cleared. Each counter stage further comprises at least one output for a counter stage signal that indicates the state of the counter stage. The timer circuit further comprises a program bank comprising both a setting circuit and a clearing circuit associated with each counter stage. Each setting circuit provides a set signal to the set input of the associated counter stage in response to a counter load signal from a control circuit and each clearing circuit provides a signal to the clear input of the counter stage in response to one of a counter load signal and a power-on RESET signal. The clearing circuit produces a signal of finite duration, but the setting circuit is configured to provide a set signal having either of two different finite durations, one of which exceeds the duration of the clearing circuit signal. The associated counter stage can receive signals from the setting circuit and the clearing circuit simultaneously, and the counter stage is configured so that the longer signal determines the initial state of the associated counter stage. The timer circuit further comprises a control circuit which is responsive to a power-on RESET signal and to an electrical initiation signal for issuing the counter load (RST) signal and the clock enable (CLKEN) signal.

According to one aspect of the invention, each setting circuit may comprise a non-volatile program means that can be set to make the setting circuit provide the set signal of longer duration than the clearing circuit signal. Optionally, each setting circuit may comprise a programming input and a data input, wherein the state of the non-volatile program means is determined by the state of the data signal when a programming signal is received at the programming input.

According to another aspect of the invention, the non-volatile program means may comprise an EEPROM cell.

According to still another aspect of the invention, the counter stage outputs may be connected to the data inputs of the associated setting circuits so that each counter stage can provide a data signal for the associated setting circuit.

The present invention also provides a lock-out electronic timer circuit, which may or may not be programmable as described above, for issuing a timer output signal after the expiration of a time delay following the receipt of an electrical initiation signal. This timer circuit comprises an oscillator circuit (optionally as described above) which is responsive to a RESET signal, for issuing at least one reference clock signal comprising a series of reference clock pulses. A ripple counter is configured to count the reference clock pulses and to produce the timer output signal when a predetermined count is reached. There is a clock gate through which the ripple counter receives the reference clock pulses when the clock gate receives a CLKEN signal. There is also a control circuit comprising a control bank comprising three control stages connected in ripple fashion. The three control stages comprise a lock-out control stage, a counter load control stage and a clock enable control stage, and each control stage is capable of having either one of a set state and a clear state and being responsive to a RESET signal that initializes each control stage to the clear state, each control stage having an output that provides a signal indicating the state of the control stage. The control circuit further comprises a enable override circuit for generating a CLKEN signal when the clock enable control stage generates a set signal. The control circuit further comprises a programmable, non-volatile lock-out switch circuit capable of having either one of a set state and a clear state. The lock-out switch circuit is driven to the set state in response to the output signal from the lock-out control stage and it assumes a clear state in response to at least one programming signal. The lock-out switch circuit has an output connected to the logic input of the lock-out control stage and is configured to deliver a signal to the logic input of the lock-out control stage only when the lock-out switch circuit is in a clear state when it receives the initiation signal. In this way, the lock-out switch circuit enables the counter load control stage and, thereafter, the clock enable stage. The lock-out control stage provides a signal to the lock-out switch circuit to prevent the lock-out switch circuit from re-initiating the control bank until the lock-out switch circuit is reset.

According to another aspect of the invention, a timer circuit as described above can be incorporated into a transducer-circuit assembly. Such an assembly comprises a transducer module for converting a shock wave pulse into a pulse of electrical energy and an electronics module secured to the transducer module. The electronics module comprises a delay circuit and an initiation element. The delay circuit comprises storage means connected to the transducer module for receiving and storing electrical energy from the transducer module, a switching circuit connecting the storage means to an initiation element for releasing energy stored in the storage means to the initiation element in response to a signal from a delay portion comprising a timer circuit as described above. The timer circuit is operatively connected to the switching circuit for controlling the release to the initiation element by the switching circuit of energy stored in the storage means. The initiation element is operatively connected to the storage means through the switching circuit for receiving the energy from the storage means and for generating an output initiation signal in response thereto.

Any one or more of the foregoing features may be incorporated into a detonator. Such a detonator may comprise, e.g., a housing having a closed end and an open end, the open end being dimensioned and configured for connection to an initiation signal transmission means; an initiation signal transmission means in the housing for delivering an electrical initiation signal to the input terminal of a delay circuit; a power source for providing power to initiate an output initiation means; a delay circuit in the housing comprising, as described herein, and detonator output means disposed in the housing for generating an explosive output signal upon discharge of the storage means.

DETAILED DESCRIPTION OF THE INVENTION AND PREFERRED EMBODIMENTS THEREOF

Electronic circuitry in accordance with the present invention comprises an initiation delay circuit that features one or more of several novel aspects which, while they may be employed independently of one another in detonator delay circuits and in other circuitry, are preferably combined in a single circuit as described herein.

Figure 1:
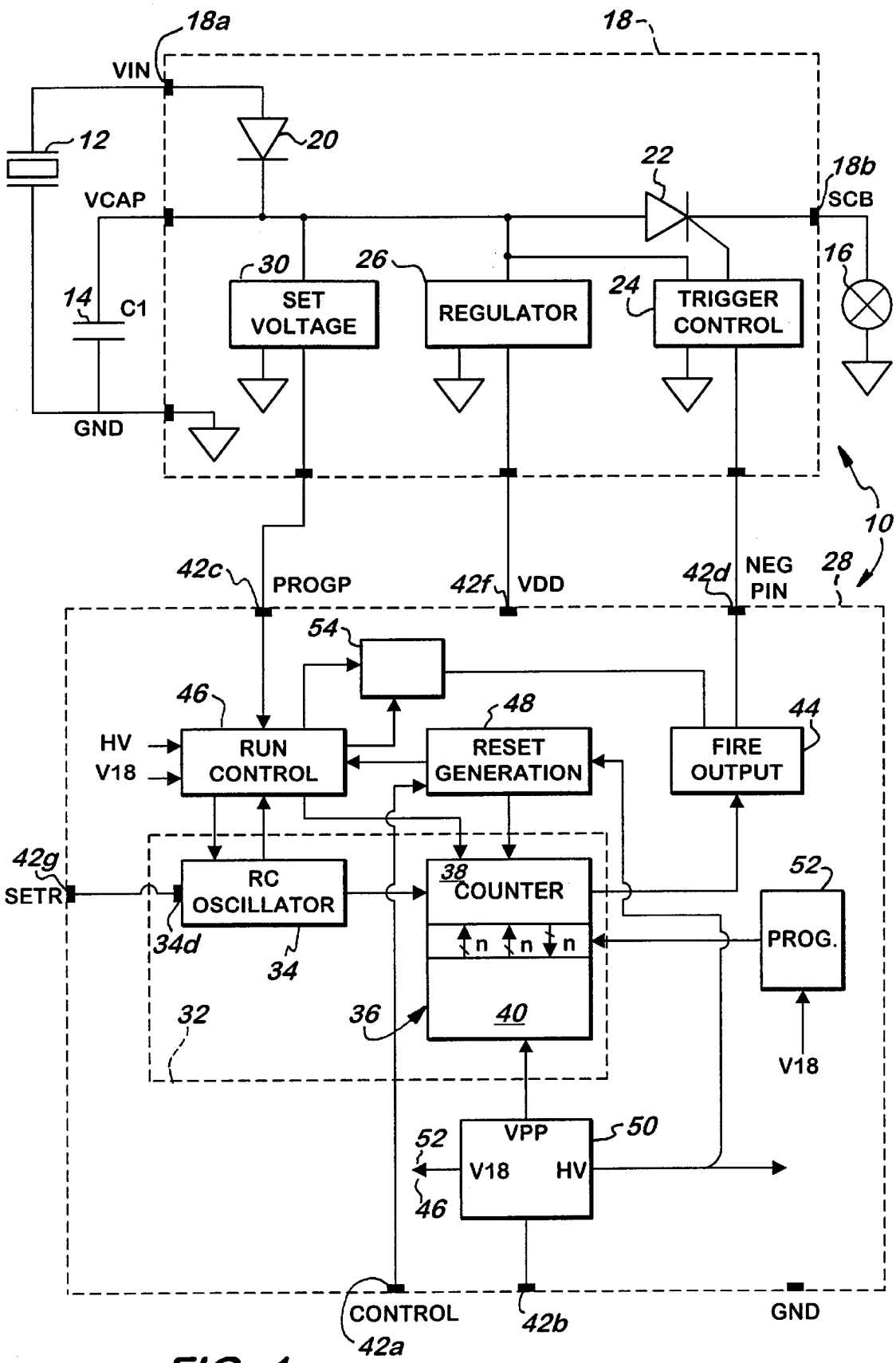
FIG. 1 is a schematic block diagram of a digital delay circuit in accordance with a particular embodiment of the present invention.

A schematic representation of an electronic initiation delay circuit that may incorporate one or more features of the present invention is provided in FIG. 1. Initiation delay circuit 10 is powered by a storage capacitor 14 that takes its charge from the output of a piezoelectric transducer 12. The piezoelectric transducer 12 is well-known in the art for producing a pulse of electrical energy in response to a pressure pulse that may be delivered by, e.g., a non-electric signal transmission line such as detonating cord or shock tube or by a small, near-by charge of explosive material. The electrical energy produced by transducer 12 provides an electrical initiation signal to delay circuit 10 at input terminal 18*a*. Most of the energy is stored by storage capacitor 14, which thereafter provides electrical energy to power initiation delay circuit 10 and to activate the electrical initiation element such as semiconductor bridge ("SCB") 16 connected to circuit 10. Semiconductor bridges are well-known in the art for use in initiating detonator output charges.

The transducer and capacitor allow the delay circuit of the present invention to be used with non-electric initiation signal lines but, in alternative embodiments, the circuit may be connected to an electrical initiation system, i.e., one in which initiation signals and, optionally, power, are conveyed to the detonator as electrical signals along fuse wires. Non-electric signal transmission lines are preferred over fuse wires where it is desired to avoid electromagnetic signal interference from radio waves, stray ground currents, lightning, etc. As will be seen, the pressure pulse that stimulates piezoelectric transducer 12 may comprise an initiation signal from which the circuit measures a delay and fires the detonator.

In a typical embodiment, detonator delay circuit 10 is assembled into two major components, a triggering portion 18 and a delay portion 28, both of which comprise constituent circuits. Triggering portion 18 may draw power from a power source, e.g., a storage capacitor 14, and may provide a path through which capacitor 14 may receive the pulse of electrical energy from piezoelectric transducer 12, e.g., via a steering diode 20 that inhibits current flow back to transducer 12. Preferably, storage capacitor 14 comprises a 0.5 microfarad capacitor capable of providing 4 microamps for at least 10 seconds. In an alternative embodiment, triggering portion 18 may draw power from a battery. Triggering portion 18 provides a controllable trigger function that inhibits energy from a power source from initiating the electrical initiation element until a firing signal is received from the delay portion 28, indicating that the desired delay interval has passed. The trigger control function may be provided principally via a switching element such as a silicon-controlled rectifier ("SCR") 22 through which the power source, e.g., storage capacitor 14, is connected to SCB 16. In the illustrated embodiment, the switching element prevents the discharge of capacitor 14 to output terminal 18*b*, and thus to SCB 16 until the receipt of a signal from trigger control circuit 24. Trigger control circuit 24 pulls SCR 22 into a conductive state in response to a triggering signal from delay portion 28 that indicates that the desired delay interval has elapsed. Triggering portion 18 preferably also comprises a voltage regulator 26 that draws some power from capacitor 14 to provide power to the delay portion 28 of detonator delay circuit 10. Triggering portion 18 preferably also comprises a set voltage circuit 30 that generates an approximate 12 volt signal designated PROGP, which is provided to delay portion 28 through input 42*c* upon receipt of an initiation signal. The PROGP signal is used by the delay portion 28, as discussed below. Triggering portion 18 is also configured to produce a power signal VDD of approximately 5 volts, derived from the power source, upon receipt of the initiation signal.

Preferably, triggering portion 18 is fabricated as a dielectrically isolated bipolar complementary metal oxide silicon (DI BiCMOS) integrated circuit chip because such circuitry is well-suited for controlling signals of the magnitude required to power the circuit and to reliably fire the initiation element. Delay portion 28 can be implemented as a standard CMOS (complementary metal oxide silicon) circuit chip.

Preferably, the delay portion 28 is powered from voltage regulator 26 of the triggering portion 18 through input 42*f* at a voltage level designated VDD (usually about 5 volts) (sometimes referred to herein as "VDD signal"). After a predetermined delay following the receipt of the power-up VDD signal at input 42*f*, delay portion 28 generates a triggering signal on output pin 42*d* that is conveyed to the trigger control circuit 24 of triggering portion 18 to allow SCR 22 to energize SCB 16. Preferably, delay portion 28 comprises several constituent circuits, including a timer circuit 32 to measure the delay interval. The timer circuit 32 of delay portion 28 comprises an oscillator 34 and a counter 36. Preferably, timer circuit 32 is programmable and counter 36 comprises a ripple counter 38 and a program bank 40 that can set the initial value of the ripple counter 38. Delay portion 28 preferably also includes a run control circuit 46 which, after receiving the PROGP signal, prevents timer circuit 32 from being re-initialized after a transient power loss. Delay portion 28 preferably operates in two modes: a programming mode in which the delay interval to be counted by the circuit is determined, and a delay mode in which it counts the delay interval upon being powered up at the VDD voltage level from triggering portion 18. Delay portion 28 operates in its delay mode unless other particular signals of the proper voltage are provided to the run control circuit 46, as discussed below.

As indicated above, one feature of the present invention relates to a run control circuit 46 that generates signals which control the power-on reset, run sequencing and control of other functions of the detonator delay circuit 10. For example, as will be discussed further below, run control circuit 46 will assure that once the timer circuit 32 has begun counting in the delay mode, it will not be re-initiated after a transient power loss. Accordingly, run control circuit 46 will prevent the firing of the detonator should a transient power loss threaten the accuracy of the delay interval, as described below.

Figure 2A:
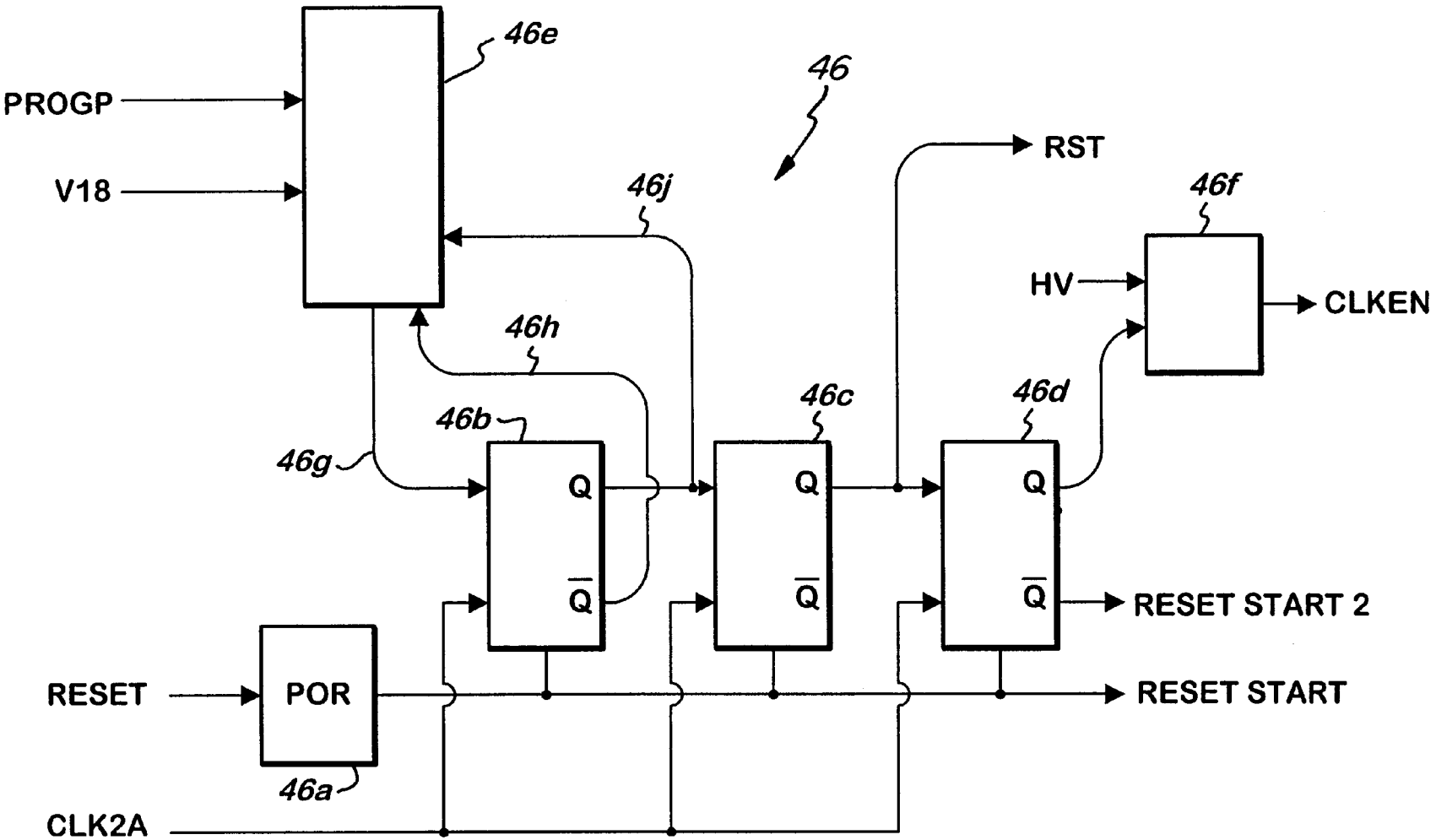
FIG. 2A is a schematic block diagram of the run control circuit of the circuit of FIG. 1.

Run control circuit 46 can be understood by reference to the schematic illustration thereof in FIG. 2A. Run control circuit 46, in the illustrated embodiment, comprises a control power-on reset ("POR") circuit 46*a* which is responsive to delay portion 28 being powered up at the VDD voltage level. POR circuit 46*a* is also responsive to an overriding RESET signal generated by the reset generation circuit 48 (FIG. 1) which is used to program the timer 32 when delay portion 28 is in its programming mode, as described below. POR circuit 46*a* responds to the VDD signal and to the overriding RESET signal, as discussed below, by generating a RESET START signal that is conveyed, for a limited time, to oscillator 34 and to each stage of a control bank comprising at least three control stages 46*b*, 46*c* and 46*d*. Preferably, each control stage is configured to have a single data input and two outputs, i.e., normal and inverted outputs. Control stage 46*b* is referred to as the lock-out control stage, control stage 46*c* is referred to as the counter load control stage, and control stage 46*d* is referred to as the clock enable control stage. The RESET START signal generated by POR circuit 46*a* clears each of the control stages by setting the normal output of each control stage to an inactive or low logic state, and it initiates the oscillator 34, as will be discussed below. Control stages 46*b*, 46*c* and 46*d* are connected together in ripple fashion to carry a signal from one to the next in accordance with a clock signal CLK2A provided by the oscillator 34.

Run control circuit 46 further comprises a lock-out switch circuit 46*e* which is configured to receive input signals from lock-out control stage 46*b* and, from off-chip sources, a PROGP signal at input 42*c* (FIG. 1) and a V18 signal. The PROGP signal is received at input 42*c* after triggering portion 18 receives the electric initiation signal and the V18 input signal, which is used during programming, as described below. Lock-out switch circuit 46*e* comprises a lock-out cell (described further below) that may have either an active state or an inactive state. The lock-out cell is non-volatile, meaning that its state will be preserved even in the event of a loss of power to any part of timer circuit 10, and it will only change upon receipt by lock-out switch circuit 46*e* of particular signals, as described herein. For example, lock-out switch circuit 46*e* may comprise a non-volatile, but erasable, electrically programmable read-only memory (EEPROM) cell. Lock-out switch circuit 46*e* is configured so that when time delay portion 28 is powered by the VDD signal for the first time after being programmed, the lock-out cell will be in the active state and the initial state of lock-out signal on line 46*g* will be active. The two outputs of control stage 46*b* are provided to lock-out switch circuit 46*e*, as described below, and the normal output of control stage 46*b* is additionally provided to the input of counter load stage 46*c*.

The normal output of counter load control stage 46*c* is not only connected to an input of the clock enable control stage 46*d*, but is also provided as a counter load RST signal to the timer, as will be described below. Upon receipt of an active input signal from counter load control stage 46*c*, clock enable control stage 46*d* generates an active output signal on its normal output that is provided as an input to enable override circuit 46*f*, and an inactive output signal RESET START Z on its inverted output. The inactive RESET START Z signal releases fire resetting circuit 54 (FIG. 1), thereby allowing a triggering signal to be provided to triggering portion 18 after the predetermined delay interval. Enable override circuit 46*f* receives the output of clock enable control stage 46*d* and, from a source that will be described below, a signal designated HV, which is provided when delay portion 28 is placed into its programming mode. Enable override circuit 46*f* emits a clock enable signal CLKEN when it receives an active signal from stage 46*d*, unless it receives an active HV signal. Thus, enable override circuit 46*f* is disabled by an active HV signal.

Upon power-up of delay portion 28 in the delay mode, the lock-out signal on line 46*g* will be placed in its active state and POR circuit 46*a* clears control stages 46*b*, 46*c* and 46*d*, i.e., their normal outputs are inactivated. Once the POR circuit 46*a* times out and the RESET START signal becomes inactive, lock-out control stage 46*b* responds to the receipt of a pulse of clock signal CLK2A, i.e., it "clocks", by generating a normal output signal Q that follows the logic state of the lock-out signal on line 46*g*. This change in the normal output of control stage 46*b* from inactive to active erases the lock-out cell, i.e., puts the cell in the inactive state, but lock-out switch circuit 46*e* will maintain an active lock-out signal on line 46*g* as long as POR circuit 46*a* does not generate a subsequent RESET START signal. The active normal output of lock-out control stage 46*b* on line 46*j* will, on the next clock pulse, activate the output from counter load control stage 46*c*. The active output from stage 46*c* provides the RST signal and an active input to clock enable control stage 46*d*. With an active input, the next clock pulse will cause stage 46*d* to provide an active signal to enable override circuit 46*f* on the normal output. Enable override circuit 46*f* then produces the active clock enable signal CLKEN. The active input to clock enable control stage 46*d* also causes stage 46*d* to provide an inactive signal on its inverted output, i.e., the RESET START Z signal will now be inactive. As long as the input signal on line 46*g* provided to lock-out control stage 46*b* is active, subsequent clock pulses CLK2A will not affect the state of the output from stage 46*b*. Thus, it can be seen that the active RST and CLKEN signals and the inactive RESET START Z signal will continue to be produced until another RESET START signal clears the control stages, i.e., until the POR circuit 46*a* is reactivated.

The RST signal and the CLKEN signal may be necessary for the operation of the detonator delay circuit as will be described below. Since these signals are derived from the outputs of ripple-connected stages, it will be understood that they will not be produced unless the input to lock-out control stage 46*b*, which is received from lock-out circuit 46*e*, is in its active state when control stages 46*b*, 46*c* and 46*d* receive clock pulses CLK2A after the RESET START signal subsides. However, lock-out switch circuit 46*e* is configured so that its ability to generate the active signal on line 46*g* upon power-up depends on the active state of the lock-out cell. As described above, lock-out control stage 46*b* causes lock-out switch circuit 46*e* to erase the lock-out cell. Thus, even if a new RESET START signal is received, and control stages 46*b*, 46*c* and 46*d* are cleared, the RST and CLKEN signals will not be generated, because the signal on line 46*g* is inactive. In other words, control circuit 46 locks out subsequent operation of timer circuit 10 until the lock-out cell is reactivated as described herein.

The RST signal produced by run control circuit 46 in normal delay mode operation is conveyed to timer circuit 32 and to fire resetting circuit 54 (FIG. 1). The active RESET START Z signal produced by run control circuit 46 in normal delay mode operation is conveyed to fire resetting circuit 54 only in response to the RESET START signal, e.g., at power-up. The active RESET START Z signal holds fire resetting circuit 54 in its reset state so that it cannot enable fire output circuit 44 to provide a triggering signal to triggering portion 18 through output 42*d*. Fire resetting circuit 54 is configured so that upon receipt of an inactive RESET START Z signal and the RST signal (which are generated after the RESET START signal subsides and control stages 46*b*, 46*c* and 46*d* receive a series of clock pulses from signal CLK2A), it generates a signal designated CND that is conveyed to fire output circuit 44 to initialize that circuit. Then, upon receipt of a timer output signal from counter 38, the fire output circuit 44 (FIG. 1) will issue the triggering signal on pin 42*d*.

Inputs for signals V18 and PROGO to lock-out switch circuit 46*e* are employed to by-pass the lock-out function of run control circuit 46, described above, i.e., to allow run control circuit 46 to initiate the oscillator 34 and thus enable timer 32 without locking out subsequent timer functions, for programming purposes, as will be described below.

Figure 2B:
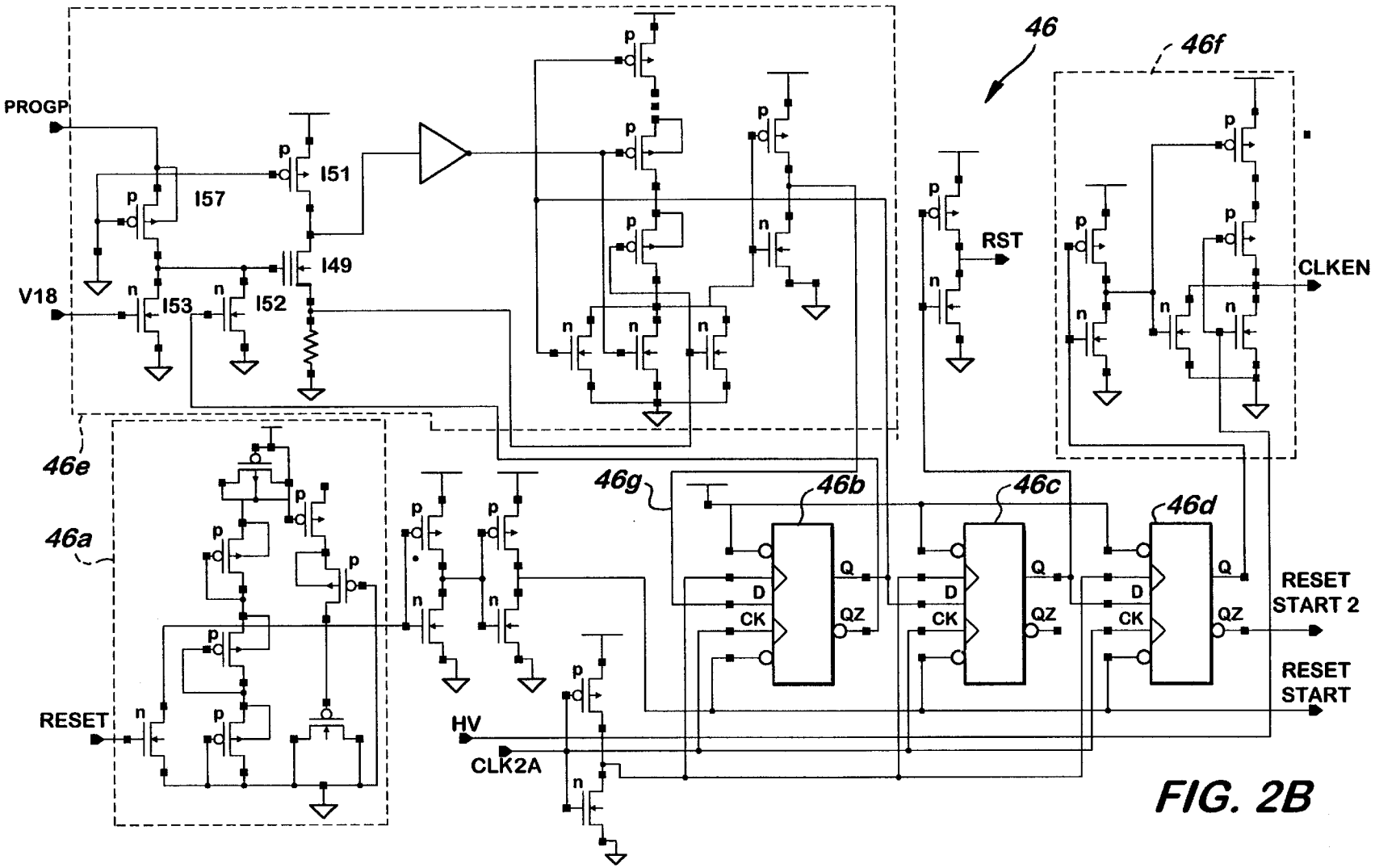
FIG. 2B is a schematic circuit diagram of a particular embodiment of the run control circuit of FIG. 2A.

A schematic circuit diagram of a particular implementation of a run control circuit in accordance with the present invention is shown in FIG. 2B. With reference to FIG. 2B, it can be seen that during normal operation, when the set voltage circuit 30 (FIG. 1) generates the PROGP signal (approximately 12 volts) and the POR circuit 46*a* issues the RESET START signal, the program gate of EEPROM cell I49 in lock-out switch circuit 46*e* is held low and that the drain of transistor I51 determines the state of the signal on line 46*g*. Provided that the EEPROM cell I49 was previously cleared to a high impedance mode when the delay portion 28 was programmed, the drain of transistor I51 will be high, thus providing an active lock-out signal on line 46*g* to lock-out control stage 46*b*. Later, when the outputs of stage 46*b* toggle, the gate of transistor I52 is driven low. The program gate, comprising transistor I57, which was holding the program gate of EEPROM cell I49 low, is then released, and EEPROM cell I49 is allowed to go to a conductive state. As discussed above, this condition provides a "permanent" inactive input to control stage 46*b* upon generation of a RESET START signal due to a transient power loss. Future restarts of timer 32 are disabled because the drain of transistor I51 will be low and the signal on line 46*g* will be inactive. If, due to a transient power loss resulting from, for example, an intermittent connection between capacitor 14 and triggering portion 18 in which a subsequent RESET START signal is generated by POR circuit 46*a*, EEPROM cell I49 will not be cleared and the control stages will remain locked out.

The source of the CLK2A signal on which the run control circuit 46 depends can be any conventional oscillator circuit. The present invention, however, provides a novel oscillator illustrated schematically in FIG. 3A. Broadly described, oscillator 34 operates by providing an RC circuit for the discharge of a charged capacitor. The charge carried by the capacitor is monitored by a comparator which generates a signal when the capacitor voltage falls below a reference voltage REF, i.e., when the capacitor becomes discharged. The signal is used by a switching means that substitutes a charged capacitor for the discharged capacitor and connects the discharged capacitor to the power source that charges it to a voltage that exceeds REF. Typically, then, the oscillator comprises two capacitors, although in other embodiments more than two capacitors may be employed.

Figure 3A:
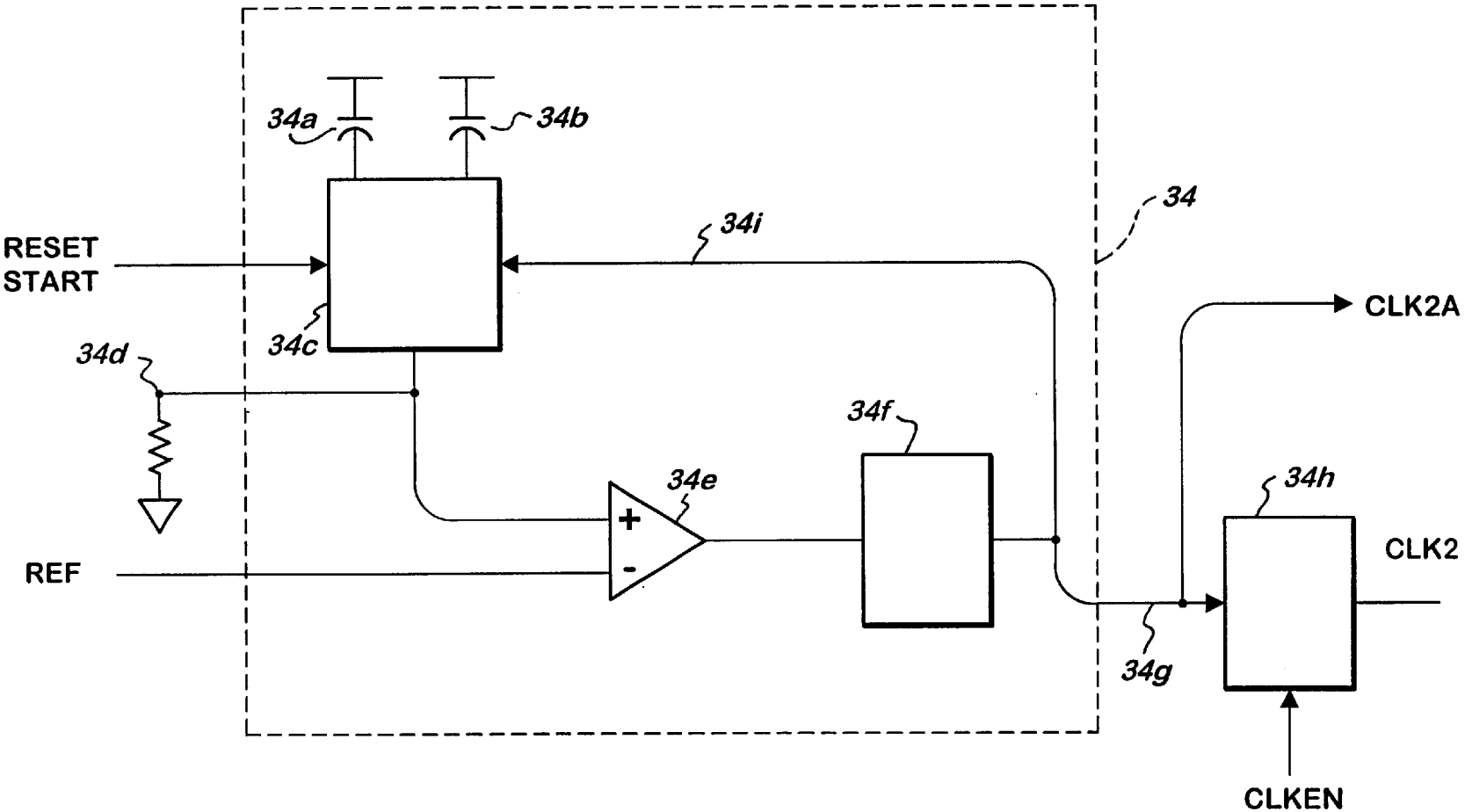
FIG. 3A is a schematic block diagram of the oscillator circuit portion of the circuit of FIG. 1.

With reference to the embodiment depicted schematically in FIG. 3A, the oscillator 34 comprises a first capacitor 34*a* and a second capacitor 34*b*. A switching circuit 34*c* serves to connect one capacitor to an off-chip resistor connected to node 34*d* through which the capacitor is discharged. The resistor at node 34*d* is connected to the chip at the SETR input 42*g* (FIG. 1). Switching circuit 34*c* also connects the other capacitor to a charging source. In response to a signal received on line 34*i*, the switching circuit 34*c* effectively reverses the position of the two capacitors. The capacitor charge, i.e., the charge on the capacitor that is being discharged through node 34*d* or a related charge, e.g., the charge on node 34*d*, is compared to a reference voltage by comparator 34*e*. When the capacitor charge falls below the reference voltage, comparator 34*e* generates a signal that is conveyed to a latch 34*f*. Upon receipt of the comparator signal, latch 34*f* generates a signal that is taken as the output signal of the oscillator on line 34*g*. The output of latch 34*f* may also be provided as the switching signal to switching circuit 34*c*, along switch signal line 34*i*. Thus, as capacitors 34*a* and 34*b* are alternately charged and discharged, latch 34*f* will produce a series of pulses comprising a clock signal. As indicated in FIG. 3A, the clock signal on line 34*g* is designated CLK2A, and this is the clock signal that drives the ripple operation of run control circuit 46. FIG. 3A also illustrates a clock gate 34*h* that receives an output signal from latch 34*f* but which requires the CLKEN signal from run control circuit 46 in order to produce a CLK2 signal corresponding to the clock signal produced by latch 34*f*. The CLK2 signal is used to increment the ripple counter. Together, the counter and the oscillator comprise a timer, the operation of which is controlled by run control circuit 46 through clock gate 34*h*. Without an active CLKEN signal, clock gate 34*h* will not generate the CLK2 signal even though latch 34*f* is generating CLK2A signals for use elsewhere in delay portion 28. Thus, the operation of the timer as a whole and, in particular, the operation of the counter in response to the clock pulses, depends on the presence of an active CLKEN signal.

The frequency of the oscillator is the frequency with which each output Q, QZ returns to a given state, e.g., the frequency with which output Q toggles to the high or active state. It will be understood by one of ordinary skill in the art that the resistance value of the resistor on node 34*d* will affect the time constant for the discharge of a capacitor connected thereto, and that the resistor can be chosen to yield a desired oscillation frequency. The oscillator may have a frequency or period of, e.g., about 50 microseconds.

Figure 3B:
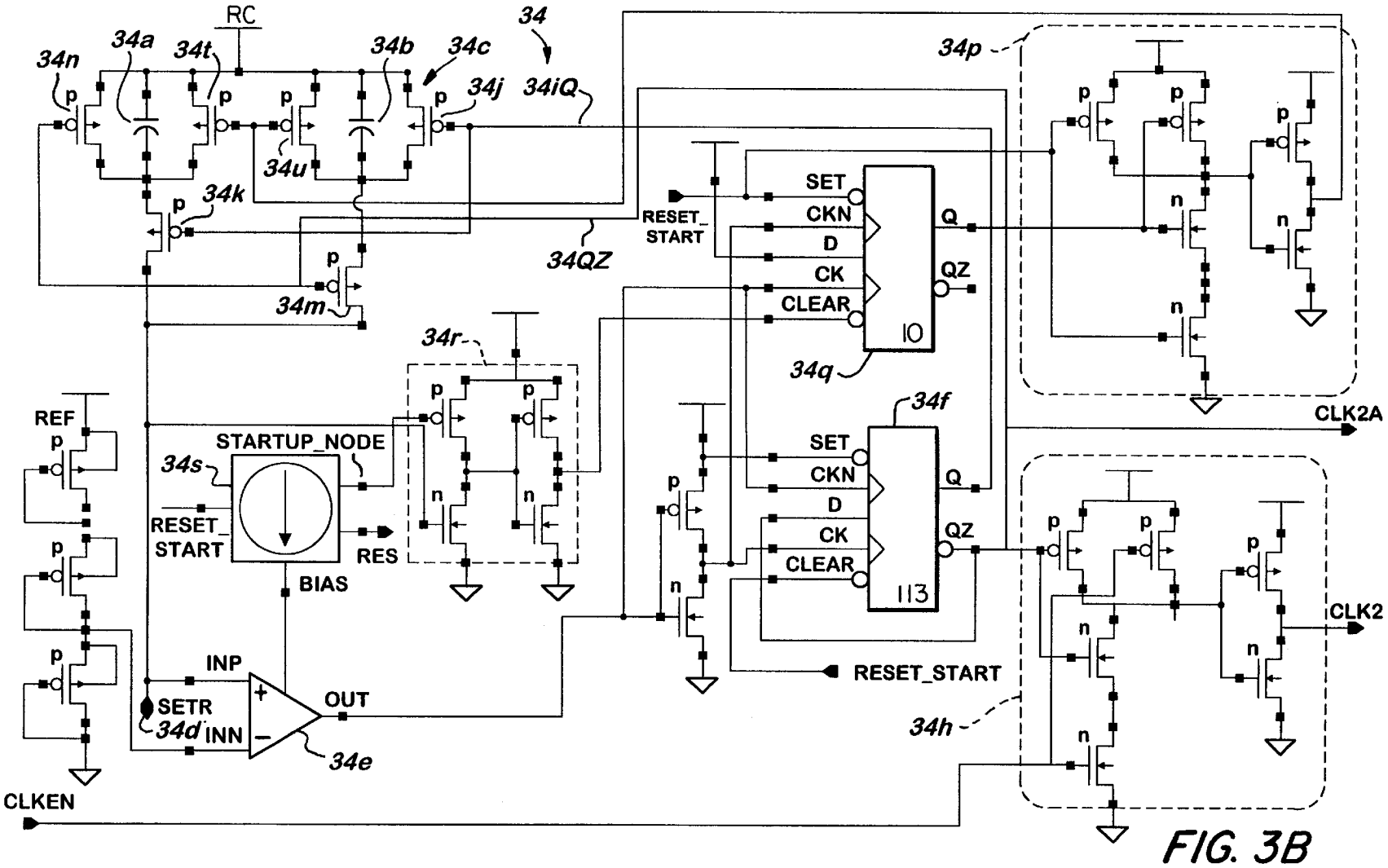
FIG. 3B is a schematic circuit diagram of a particular embodiment of the oscillator circuit portion of FIG. 3A.

A schematic circuit diagram of a particular implementation of an oscillator for use in accordance with the present invention is shown in FIG. 3B. Here it can be seen that first capacitor 34*a* and second capacitor 34*b* are embedded within a collection of transistors that comprise switching circuit 34*c*. Switching circuit 34*c* effectively connects the discharged capacitor to a power source for recharging while connecting the charged capacitor to a resistor at node 34*d* to be discharged. It can also be seen that the output of latch 34*f* comprises two outputs Q and QZ, and that the output Q controls transistors 34*j* and 34*k* via line 34*i*Q while the output QZ controls transistors 34*m* and 34*n* via line 34*i*QZ. Together, lines 34*i*Q and 34*i*QZ comprise switch signal line 34*i* of FIG. 3A.

Oscillator 34 (FIG. 3B) comprises forced start circuitry comprising charge control circuit 34*p*, flip-flop 34*q*, start-up circuit 34*r* and bias circuit 34*s*, to initiate the operation of the oscillator at power-up even when a large capacitance is imposed on the resistor on node 34*d* for testing or programming purposes. At power-up, charge control circuit 34*p* turns on transistors 34*t* and 34*u*, thus beginning the charging process for capacitors 34*a*, 34*b* and overcoming any stray capacitance on node 34*d*. When the RESET START signal becomes active, the output of start-up circuit 34*r* causes output signal Q of flip-flop 34*q* to go low, so the "on" signal provided to transistors 34*t* and 34*u* remains on. Charging continues until the capacitor voltage sensed by the comparator 34*e* at INP exceeds ⅔ VDD. At that point, comparator 34*e* switches to a high state, causing output Q of flip-flop 34*q*, which is connected to charge control circuit 34*p*, to go high. In response, charge control circuit 34*p* turns off transistors 34*t* and 34*u*. The voltage at the INP input to comparator 34*e* then starts to fall, discharging capacitor 34*a* through the resistor at node 34*d*. When INP falls below ⅔ VDD, the comparator switches to a low state, causing latch 34*f* to toggle. Normal oscillator function then proceeds as described above.

Figure 3C:
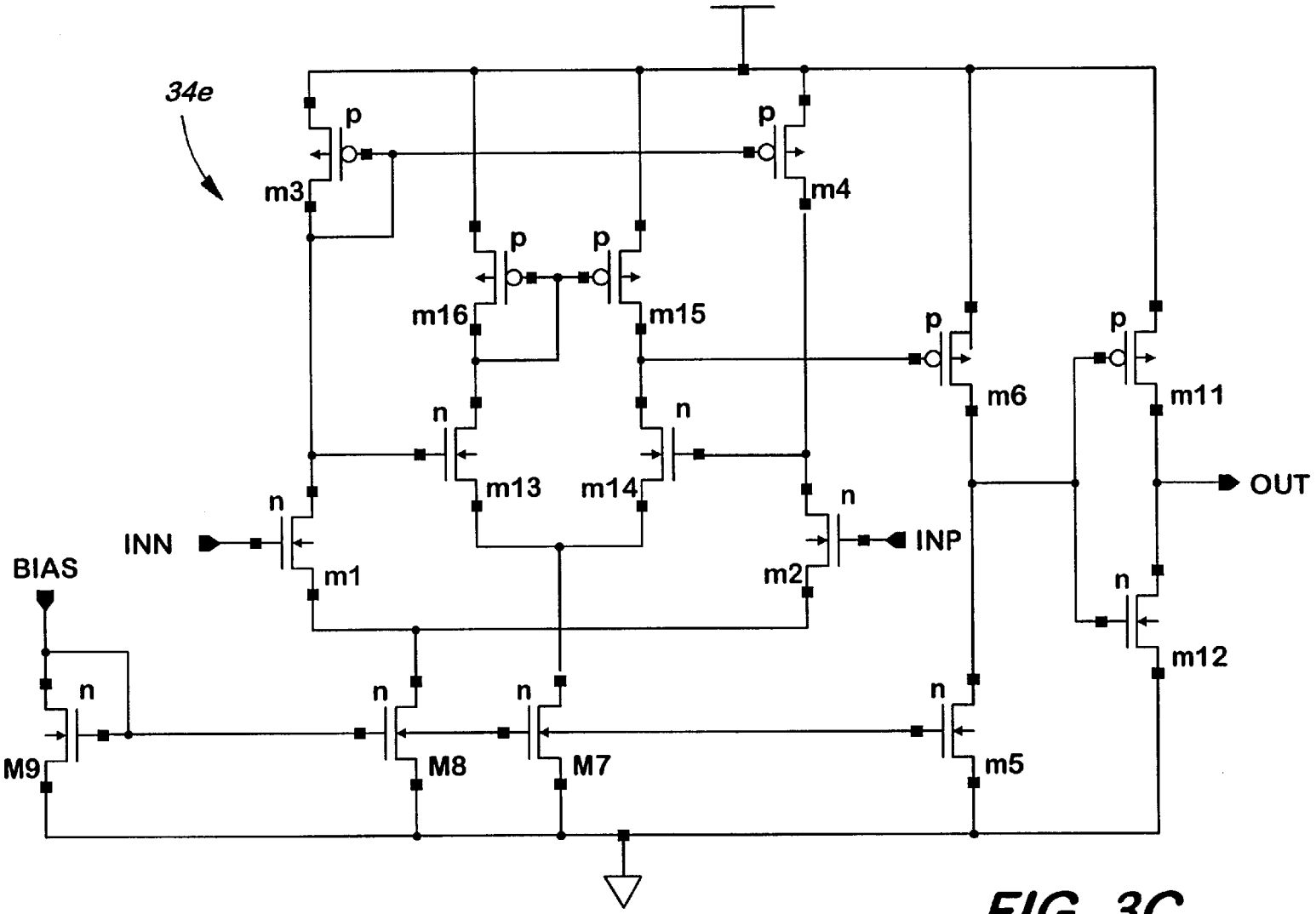
FIG. 3C is a circuit diagram of one embodiment of comparator 34*e* of FIG. 3B.

FIG. 3C indicates a preferred circuit configuration for comparator 34*e*, which embodies a high gain, double-stage, low current draw, fast-switching circuit. The bias input signal is current mirrored at M9, M8, M7 and M5. Transistors M1, M2, M3 and M4 comprise the first stage of the input differential amplifier and transistors M13, M14, M15 and M16 comprise the second stage.

Figure 3D:
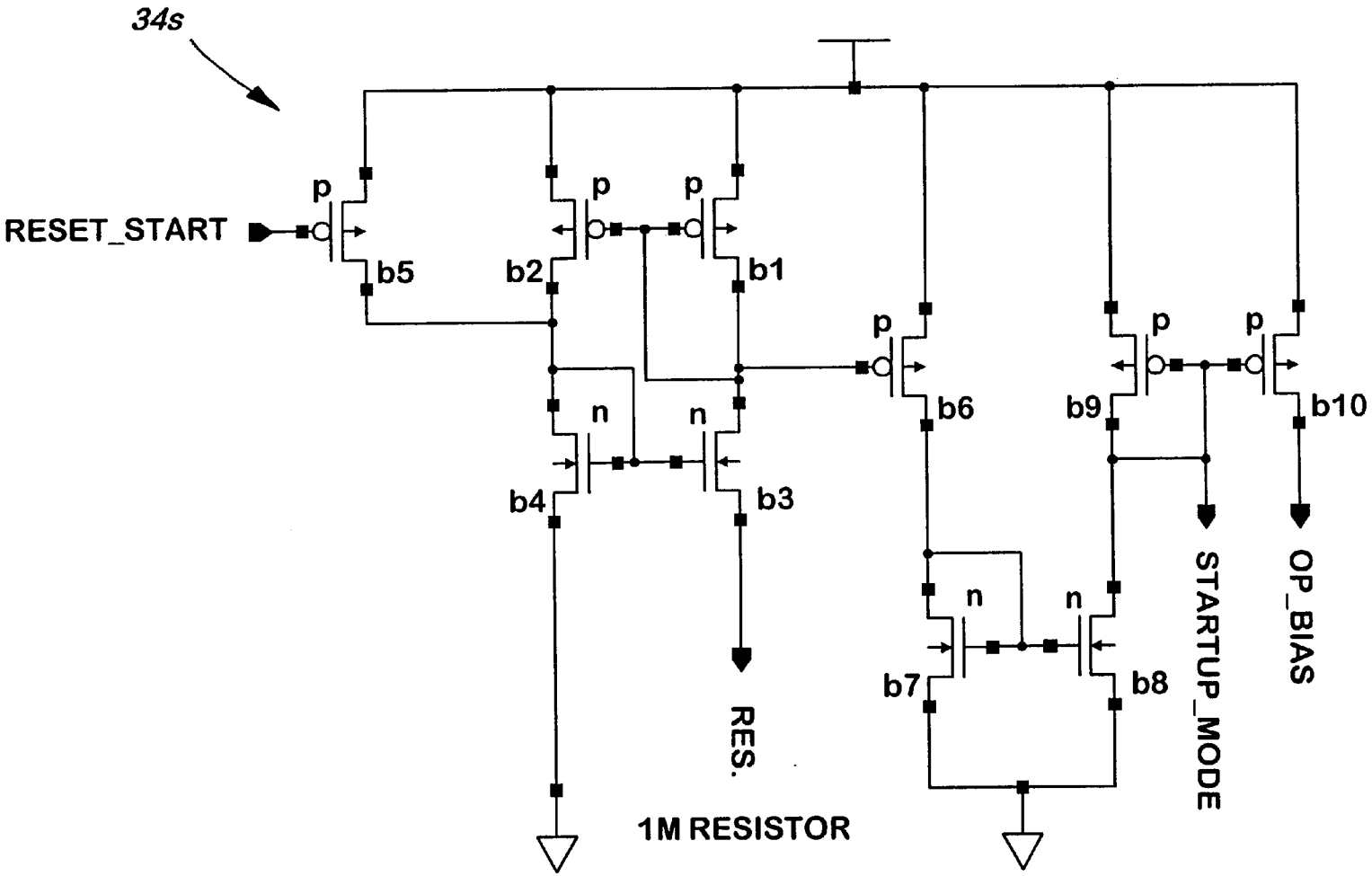
FIG. 3D is a circuit diagram of one embodiment of the bias circuit 34*s* of FIG. 3B.

FIG. 3D illustrates a preferred circuit configuration for bias circuit 34*s* of FIG. 3B. Transistor b5 ensures that the quad transistor set b1, b2, b3 and b4 powers up upon receipt of the RESET START signal. The quad set provides a stable voltage source over circuitry variations typical in CMOS manufacturing by taking advantage of the differences of threshold voltages between p-type and n-type transistors. The remaining transistors in circuit 34*s* sets the bias of comparator circuit 34*e* and limits the current drawn by the start-up circuit 34*r*.

The clock signals from oscillator 34 (FIG. 3A) can be supplied to any conventional ripple counter that may be programmed to generate a timer output signal after counting a specified number of clock pulses. One aspect of the present invention, however, relates to a novel programmable counter 36 (FIG. 1) that can be used in a detonator circuit. Programmable counter 36 comprises a ripple counter 38 that comprises a plurality of counter stages (such as D-type latches) arranged in ripple fashion. Each counter stage 38*a*, 38*b*, etc. (FIG. 4A), is capable of having either one of a "set" state and a "clear" state and comprises inputs by which the state of the counter stage can be initialized. Each counter stage comprises at least one output for providing a signal that indicates the state of that counter stage. Typically, the output is designated Q and each counter stage also provides an inverse output, e.g., QZ. Programmable counter 36 also comprises a program bank comprising a plurality of setting circuits 40*a*, 40*a*', etc., and a plurality of clearing circuits 40*b*, 40*b*', etc., there being a setting circuit and a clearing circuit associated with each counter stage. Outputs of setting circuits 40*a*, 40*a*', etc., and of clearing circuits 40*b*, 40*b*', etc., are connected to appropriate inputs of the associated counter stage and the setting circuits, clearing circuits and counter stages are configured so that an active signal from a setting circuit will place the counter stage in the set state and an active signal from the clearing circuit will place the counter stage in the clear state. The counter stages are configured so that when a clear signal and a set signal are received simultaneously, the signal of longer duration will determine the state of the counter stage. Ripple counter 38 has an inverting circuit which inverts the polarity of the PROG signal issued by the PROG circuit 52 (FIG. 1) to generate the VEN signal.

The first counter stage 38*a* (FIG. 4A) receives clock pulses from an oscillator and may receive the gated clock signal CLK2 described above with reference to FIG. 2A. The setting circuits have inputs for signals designated VPP, VEN (from the PROG circuit 52) and RST; the clearing circuits are provided with inputs for the RST signal and a RESET signal from reset generation circuit 48 (FIG. 1).

Each setting circuit can assume either of two states in which it generates a set signal of long or short duration, respectively. The state of the setting circuit can be fixed by a data signal provided at a suitable data input P. In a preferred embodiment, an output signal from the associated counter stage provides the data signal at data input P of the setting circuit to facilitate a particular programming method described below.

To facilitate programming, delay portion 28 (FIG. 1) comprises a control input 42*a*, a power input 42*f* (for a power signal designated VDD, typically about 5 volts), a reset generation circuit 48 and a program input 42*b* (sometimes designated V18), the latter being a multi-function input, as will be explained below.

Figure 4A:
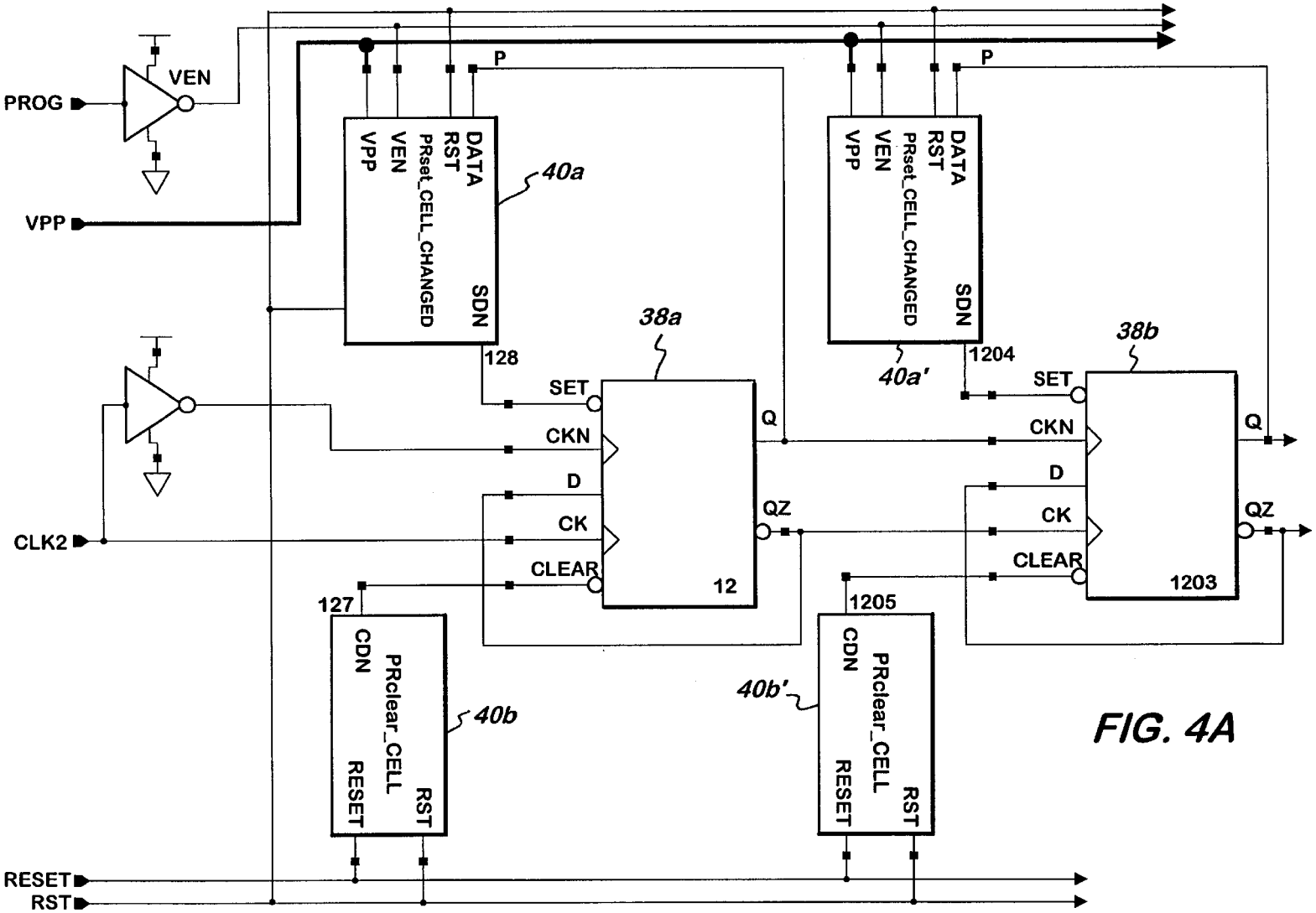
FIG. 4A is a schematic block diagram of a programmable counter in accordance with a particular embodiment of the counter portion of the circuit of FIG. 1.

The procedure for programming the counter schematically illustrated in FIG. 4A is as follows. First, power-up signals of about 5 volts are provided at inputs 42*b* and 42*f* (FIG. 1) from an external programming device. A logic high or active CONTROL signal is provided from the external device via input 42*a* to reset generation circuit 48. Reset generation circuit 48 generates a RESET signal which is provided to POR circuit 46*a* (FIG. 2A) of run control circuit 46 (FIG. 1) to override the internal POR function and reset the entire delay portion 28. When the CONTROL signal is drawn low, the POR circuit 46*a* (FIG. 2A) generates a RESET START signal that resets the run control stages and activates the oscillator circuit 34. Oscillator 34 begins cycling and drives the control stages of the run control circuit 46. When circuit 46*f* generates the CLKEN signal, clock pulses are released to the ripple counter 38, which starts to increment. The oscillator 34 and counter 36 are allowed to cycle for the desired time interval, at which point the signal at input 42*b* is raised above VDD by at least one volt, i.e., VDD+1. Preferably, the signal at input 42*b* is initially 0.5 volts less than VDD (i.e., VDD−0.5) and is raised to 2 volts greater than VDD (VDD+2) after the desired time interval has elapsed.

As indicated in FIG. 1, input 42*b* is connected to a V/H circuit 50 which buffers and distinguishes between various signals from input 42*b* and generates appropriate output signals. When the signal at 42*b* is increased to exceed VDD by more than 1 volt at the end of the desired time delay, the V/H circuit produces an HV signal that is conveyed to circuit 46*f* (FIG. 2A) of run control circuit 46. Circuit 46*f* responds by inactivating the CLKEN signal, thus stopping the timer by preventing the oscillator from further incrementing the counter via gate 34*h* (FIG. 3A). V/H circuit 50 also produces a programming signal VPP whenever the signal at input 42*b* exceeds 6 volts. (The effect of the VPP signal will be discussed further below.) Accordingly, a signal of at least 0.5 VDD introduced at input 42*b* will result in the generation of a PROG signal. A signal at input 42*b* that exceeds VDD+1 will result in the generation of an HV signal that stops the counter, and a signal at input 42*b* that exceeds 6 volts will result in the generation of a VPP signal. During programming, the signal at input 42*a* will reach about 14 volts, and lock-out switch circuit 46*e* (FIG. 2A) is configured so that such a signal resets the lock-out bit thereon.

In view of the function of V/H circuit 50 as described above, providing an initial signal at input 42*a* of between 0.5 VDD and VDD+1 concurrently with a control signal at input 42*a* (both of which are connected to reset generation circuit 48) yields a RESET signal that clears the ripple counter 38 and holds the POR circuit 46*a* (FIG. 2A) in the reset state. When the CONTROL signal goes low, the internal POR function concludes, the oscillator 34 (FIG. 1) starts, and the counter stages increment. After the desired time interval has passed, the signal at input 42*a* is raised above VDD+1, causing V/H circuit 50 to produce the HV signal that stops the counter as described above. The signal at input 42*b* is then increased to a level of at least 6 volts, which causes V/H circuit 50 to generate the VPP programing signal, which allows the state of the setting circuit to be determined by the state of the data signal at the setting circuit data input. The high level V18 signal also resets the lock-out bit in the run control circuit 46 to permit subsequent timer function. Thus, by initiating and terminating the CONTROL signal and adjusting the signal at input 42*b* appropriately, the power-up sequence and clock operation that occur in normal operation (i.e., as the result of an input signal at input 18*a* that results in a PROGP signal at 42*c*) can be synchronized with measurement of a desired time delay by an external programming device, to properly program the timer circuit with the desired time delay.

In the illustrated preferred embodiment, the setting circuits receive the output signals from the associated counter stages, so that the state of each counter stage at the time when the counter is stopped, i.e., at the end of the desired interval, is reflected by the state of the associated setting circuit. Preferably, each setting circuit comprises a non-volatile circuit element such as an EEPROM cell that is programmed by the state of the input data signal to the setting circuit. Accordingly, once the state of the setting circuit has been programmed, power can be withdrawn from the timer circuit and the configuration of the counter at the end of the desired delay will be retained.

In operation, once the timer has been reset in response to a RESET signal, the initial states of the counter stages must be loaded from the associated setting circuits. This is accomplished when the RST signal is generated by the run control circuit illustrated in FIGS. 2A and 2B. The RST signal allows both the setting circuit and the clearing circuit associated with each counter stage to convey a signal to the counter stage.

The setting circuit and the clearing circuit are configured so that after the RST signal pulse goes low, they generate their signals to the associated counter stage simultaneously but for different time intervals. Generally, the setting circuits are configured so that when they are unprogrammed, the time constant for the setting circuit is about one-half of the time constant of the clearing circuit. Accordingly, the clear signal will be of longer duration than, and will prevail over, the set signal of an unprogrammed setting circuit, and the counter stage will be cleared. On the other hand, the setting circuits are configured so that, if the non-volatile program means, e.g., the EEPROM cell, is programmed, the time constant of the setting circuit is extended beyond the time constant of the clearing circuit, so that after the RST signal dies, the set signal will prevail over the clear signal and the counter stage will be set or "loaded" with the programming of the setting circuit.

Figure 4B:
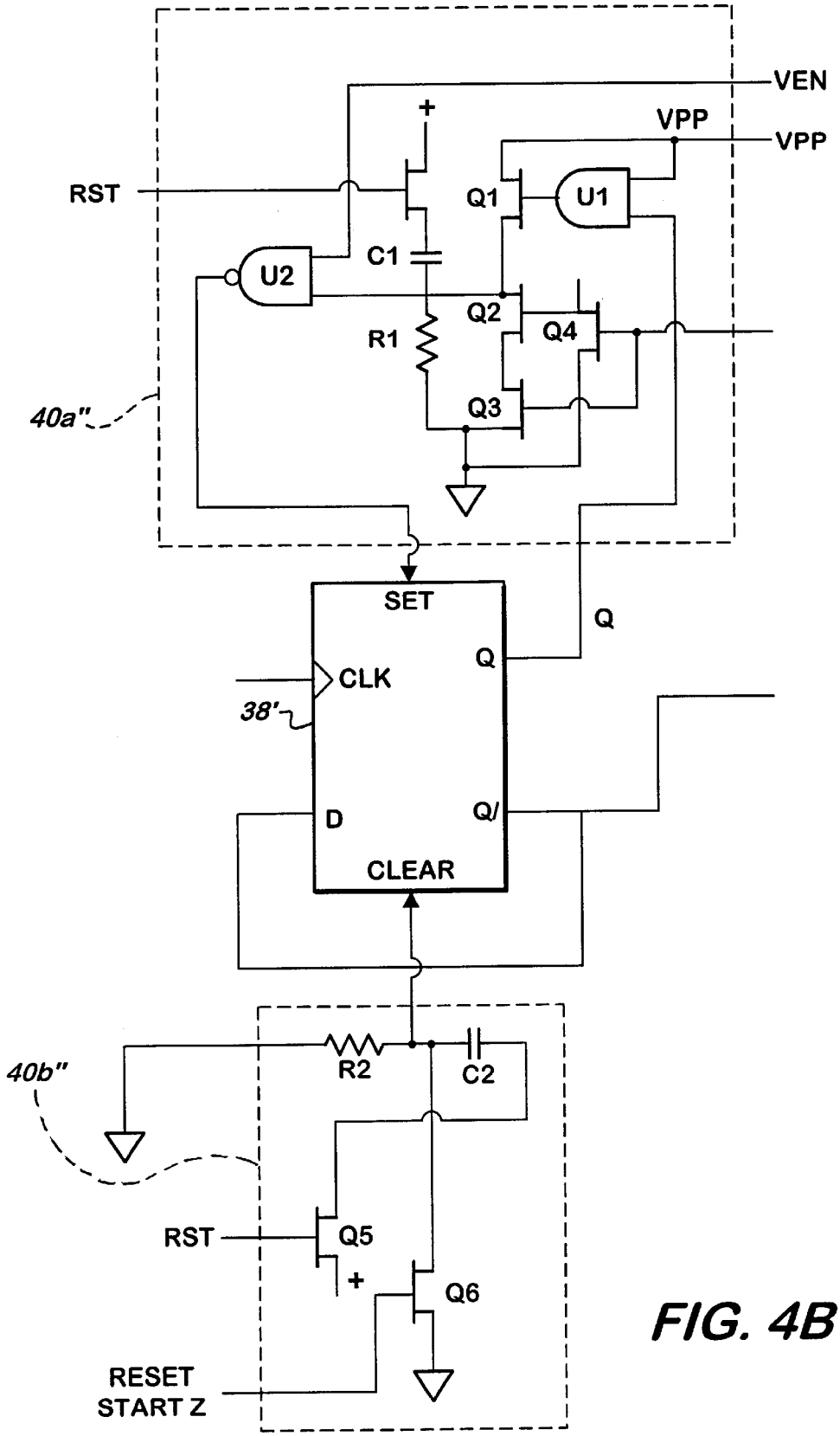
FIG. 4B is a schematic diagram of a counter stage and an associated setting circuit and clearing circuit according to a particular embodiment of the counter of FIG. 4A.

Additional detail for particular embodiments of setting circuits and clearing circuits for use in a counter according to the present invention is seen in FIG. 4B, which shows a counter stage 38' with its associated setting circuit 40*a*" and associated clearing circuit 40*b*". In setting circuit 40*a*", Q2 indicates the non-volatile EEPROM cell.

Once programming is complete, subsequently received signals PROGP and VDD at inputs 42*c* and 42*f*, respectively, will cause POR circuit 46*a* to generate a RESET START signal for the various circuit components of delay portion 28, and it causes oscillator 34 to begin functioning. When the PROGP signal and the initial pulses from oscillator 34 are received by run control circuit 46, run control circuit 46 produces the RST signal, the CLKEN signal, and the RESET START Z signal which enable other circuits in delay portion 28 to function. At the same time, a lock-out portion of run control circuit 46, i.e., lock-out switch circuit 46*e*, is set to prevent subsequent operation of the run control sequence. Accordingly, in the event of a transient power loss at input 42*f* after timer operation has begun, the restoration of power to input 42*f* will not result in the reloading of the counter or re-initiation of the timer because the non-volatile lock-out cell of run control circuit 46, which was set prior to the loss of power, will prevent run control circuit 46 from enabling these functions. Specifically, lock-out switch circuit 46*e* will continue generating an inactive output signal despite the loss and re-instatement of power to delay portion 28, and the inactive signal received by lock-out control stage 46*b* will prevent the generation of active RST and CLKEN signals. Thus, the delay circuit of the present invention assures that the detonator will not fire if a transient power loss occurs during the delay interval.

Figure 4C:
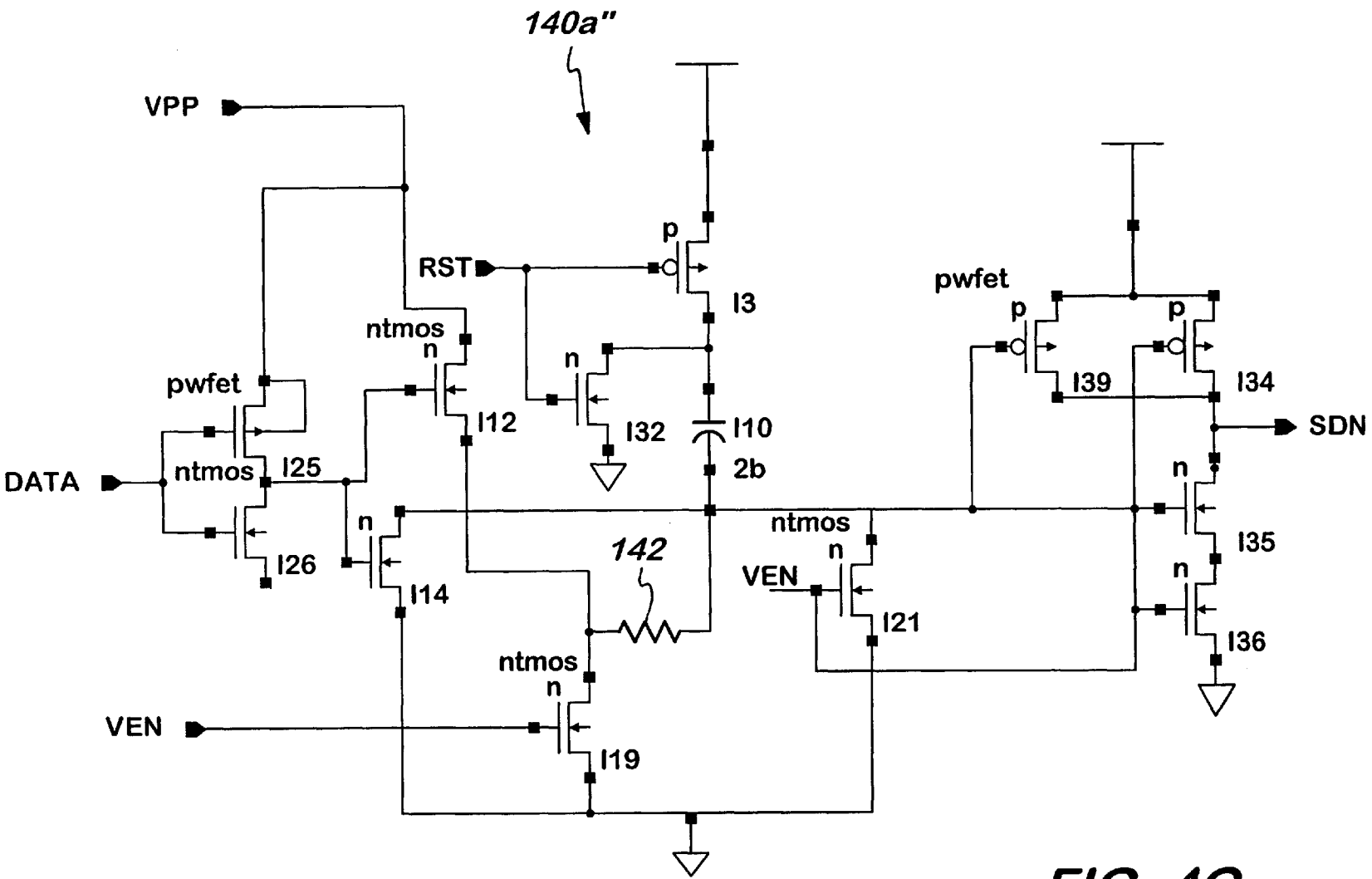
FIG. 4C is a circuit diagram of an alternative embodiment of a setting circuit of the programmable counter of FIG. 4A.

In an alternative embodiment of a programmable electronic timer circuit in accordance with this invention, the non-volatile program means of the setting circuit may comprise a fusible link instead of an EEPROM cell. A circuit diagram for such a setting circuit is shown in FIG. 4C. Setting circuit 140*a*" has the inputs for the same signals as setting circuit 40*a*" of FIG. 4B, i.e., VEN, VPP, RST, data (Q), and generates the same output signal, SDN (set). The programming of setting circuit 140*a*", and the loading of an associated counter stage therefrom is accomplished in generally the same way as for setting circuits comprising EEPROM cells. However, the programming procedure results either in leaving the fusible link 142 intact, or in causing it to open. Specifically, when an active signal from the corresponding counter stage is received on the data input during the programming process, fusible link 142 remains intact. Subsequently, when the settings of the program bank are loaded into the counter, the intact fusible link effectively short-circuits the output signal of setting circuit 140*a*". Accordingly, the clearing signal from the clearing circuit outlasts the setting signal from the setting circuit, and the corresponding counter stage is cleared. Conversely, when an inactive signal or "zero" is received at the data input during programming, the fusible link is opened. When the associated counter stage is later loaded, setting circuit 140*a*" is able to produce a setting signal (SDN) that outlasts the clearing signal from the associated clearing circuit, and the counter stage will then be set.

Typically, more current is required to open a fusible link than to set an EEPROM cell. Accordingly, setting circuit 140*a*" has a somewhat different configuration than setting circuit 40*a*" of FIG. 4B. For example, circuit elements 112 and I14 of setting circuit 140*a*" are larger than corresponding elements of circuit 40*a*" such as $Q_1$ and $Q_4$, so that they can handle sufficient current to open the fusible link at voltages consistent with CMOS circuitry.

An alternative programming method would be to trim (i.e., open) the appropriate fusible links using a laser instead of running the counter for a desired time interval and using the output signals from counter stages to control fuse-opening currents. In this alternative approach, more reliance is placed upon the accuracy of the oscillator frequency than in the previously described programming method. In the previously described method, the circuit is allowed to run for a period of time measured against an external known clock, and when the desired interval is reached, the counter is stopped and the program bank is programmed according to the output signals of the counter stages. Thus, all the timers will measure the interval counted by the external clock even if oscillator frequencies (and therefore the program counts) vary from chip to chip. The trimming method, however, is insensitive to variations in ocillator frequency and can only establish a known delay if the oscillator frequency is known in advance. Therefore, the trimming method requires greater precision in oscillator manufacture.

While, in the embodiment of FIG. 1, delay portion 28 is used in connection with a triggering portion 18 to control the firing of an SCB for the initiation of a detonator, the triggering signal produced by delay portion 28 can be used to control any device that must operate within a predetermined time interval from the receipt of the initiation signals provided to delay portion 28.

Similarly, programmable timer circuit 32 can be used in devices other than detonators wherever an electronically programmable and non-volatile timer is needed. Likewise, oscillator 34, which is advantageously employed as part of a timer, can be used as part of any other device requiring a clock pulse.

Figure 5:
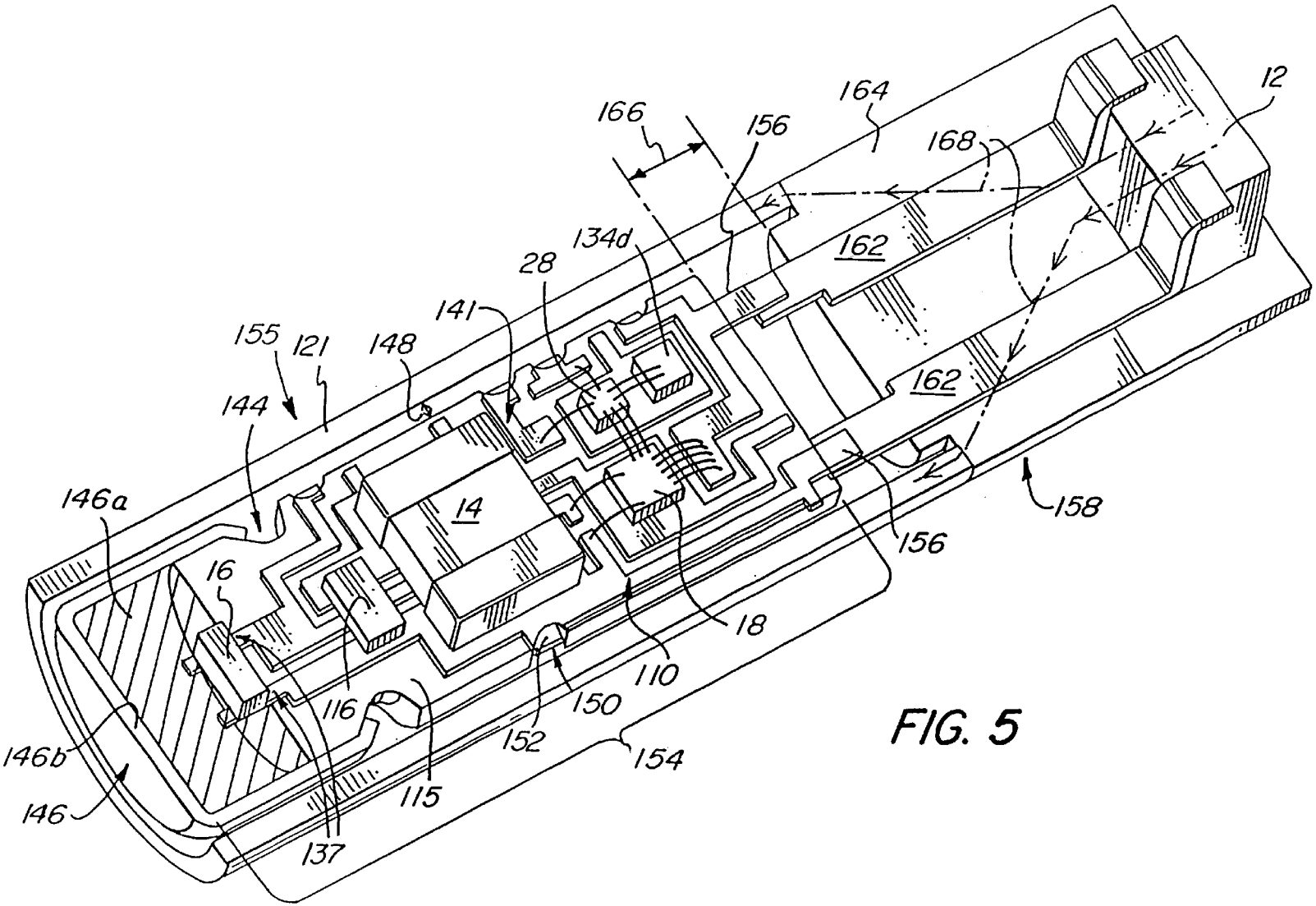
FIG. 5 is a partly cross-sectional perspective view of a transducer-circuit assembly comprising an electronics module and sleeve together with a transducer module.

An electronic delay circuit in accordance with the present invention can be incorporated into a transducer-circuit assembly generally shown in FIG. 5 for convenient incorporation into a detonator. Transducer-circuit assembly 155 comprises an electronics module 154 that comprises the delay circuit 10 of FIG. 1 with an initiation element 146 (e.g., an SCB) attached thereto. FIG. 5 shows various components of delay circuit 10, including delay portion 28 with an associated resistor 134*d* (attached to node 34*d*, FIG. 3A), a triggering portion 18, a storage capacitor 14, an optional bleed resistor 116 (for slowly discharging capacitor 14 should the detonator fail to fire after capacitor 14 is charged, in embodiments that do not include the lock-out feature described above) and output leads 137 that provide an output terminal to which storage capacitor 14 is discharged. These various components are mounted on lattice-like portions or traces 141 of a lead frame and, except for output leads (or out-put "terminal") 137, are disposed within an encapsulation 115. The transducer-circuit assembly 155 comprises initiation element 146 which comprises semiconductor bridge 16 (which is connected across output leads 137), an initiation charge 146*a*, which preferably comprises a fine particulate explosive material such as BNCP (tetraammine-cis-bis (5-nitro-2H-tetrazolato-$N^2$) cobalt (III) perchlorate), DXN-1, DDNP, lead azide or lead styphnate, in an initiation shell 146*b* that is crimped onto neck region 144 of encapsulation 115 and which holds initiation charge 146*a* in energy transfer relation to semiconductor bridge 16. Initiation charge 146*a* is preferably pressed into initiation shell 146*b* to a density of less than 80 percent of its theoretical maximum density (TMD). For example, the initiation unit may be pressed into shell 146*b* at a pressure of about 1,000 psi. Preferably, SCB 16 is secured to output leads 137 in a manner that allows SCB 16 to protrude into, and to be surrounded by, initiation charge 146*a*. Alternatively, such materials may be rendered in the form of a slurry or bead mix that can be applied onto the SCB. Output initiation element 146 may comprise part of the output means of a detonator and may be used, e.g., to initiate the base charge or "output" charge of the detonator in which transducer-circuit assembly 155 is disposed, as described below.

Encapsulation 115 preferably engages a sleeve 121 only along longitudinally extending protuberant ridges or fins (which are not visible in FIG. 5) and thus establishes a gap 148 between encapsulation 115 and sleeve 121 at the circumferential regions about encapsulation 115 between the fins. (Alternatively, encapsulation 115 may comprise a shock-absorbing material that may optionally make full contact with sleeve 121.) Encapsulation 115 optionally defines scallops 150 that make test leads 152 accessible but which preferably allow the leads to remain within the surface profile of encapsulation 115, i.e., the leads preferably do not extend into gap 148. If scallops 150 are omitted, it is preferred that the test leads do not extend across gap 148 to contact the surrounding enclosure. Accordingly, before the electronics module, which comprises the various circuit elements, output initiation element 146 and encapsulation 115, is placed within sleeve 121, leads such as leads 152 can be accessed to test the assembled circuitry. Then, electronics module 154 can be inserted into sleeve 121 and leads 152 will not contact sleeve 121.

Electronics module 154 is designed so that output leads 137 and initiation in-put leads 156, through which storage capacitor 14 can be charged, protrude from respective opposite ends of electronics module 154. A transducer module 158 comprises a piezoelectric transducer 12 and two transfer leads 162 enclosed within transducer encapsulation 164. Transducer encapsulation 164 is dimensioned and configured to engage sleeve 121 so that transducer module 158 can be secured onto the end of sleeve 121 with leads 162 in contact with input leads 156. Preferably, encapsulation 115, sleeve 121 and transducer encapsulation 164 are dimensioned and configured so that, when assembled as shown in FIG. 5, an air gap indicated at 166 is established between encapsulation 115 and transducer encapsulation 164. In this way, electronics module 154 is at least partially shielded from the detonation shock wave that causes piezoelectric transducer 12 to create the electrical pulse that initiates electronics module 154. The pressure imposed by such detonation shock wave is transferred through transducer module 158 onto sleeve 121, as indicated by force arrows 168, rather than onto electronics module 154. The various circuit packages and elements may be mounted directly on the metal traces 141 of a lead frame or, alternatively, on a polymeric or ceramic substrate in a chip-on-board type arrangement.

Figure 6A:
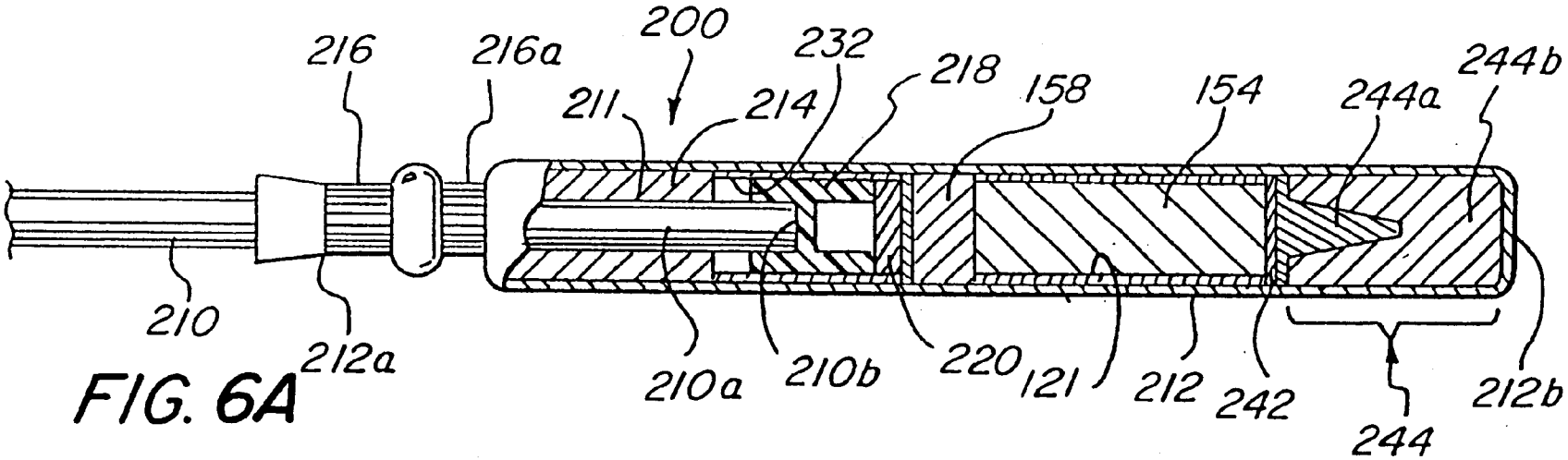
FIG. 6A is a schematic, partly cross-sectional view showing a delay detonator comprising an encapsulated delay circuit in accordance with one embodiment of the present invention.

Referring now to FIG. 6A, there is shown one embodiment of a delay detonator 200 comprising an electronics module in accordance with the present invention. Delay detonator 200 comprises a housing 212 that has an open end 212*a* and a closed end 212*b*. Housing 212 is made of an electrically conductive material, usually aluminum, and is preferably the size and shape of conventional blasting caps, i.e., detonators. Detonator 200 comprises an initiation signal transmission means for delivering an electrical initiation signal to the delay circuit. As indicated above, the initiation signal transmission means may simply comprise fuse wires connected to input terminals of the delay circuit. Preferably, however, the detonator is used as part of a non-electrical system and the initiation signal transmission means comprises the end of a non-electric signal transmission line (e.g., shock tube) and a transducer for converting the non-electric initiation signal to an electrical signal, as described herein. In the illustrated embodiment, the delay detonator 200 is coupled to a non-electric initiation signal means that comprises, in the illustrated case, a shock tube 210, booster charge 220 and transducer module 158. It will be understood that non-electric signal transmission lines besides shock tube, such as a detonating cord, low-energy detonating cord, low velocity shock tube and the like may be used. As is well-known to those skilled in the art, shock tube comprises hollow plastic tubing, the inside wall of which is coated with an explosive material so that, upon ignition, a low-energy shock wave is propagated through the tube. See, for example, Thureson et al U.S. Pat. No. 4,607,573, issued Aug. 26, 1986. Shock tube 210 is secured in housing 212 by an adapter bushing 214 that surrounds tube 210. Housing 212 is crimped onto bushing 214 at crimps 216, 216*a* to secure shock tube 210 in housing 212 and to form an environmentally protective seal between housing 212 and the outer surface of shock tube 210. A segment 210*a* of shock tube 210 extends within housing 212 and terminates at end 210*b* in close proximity to, or in abutting contact with, an anti-static isolation cup 218.

Figure 6B:
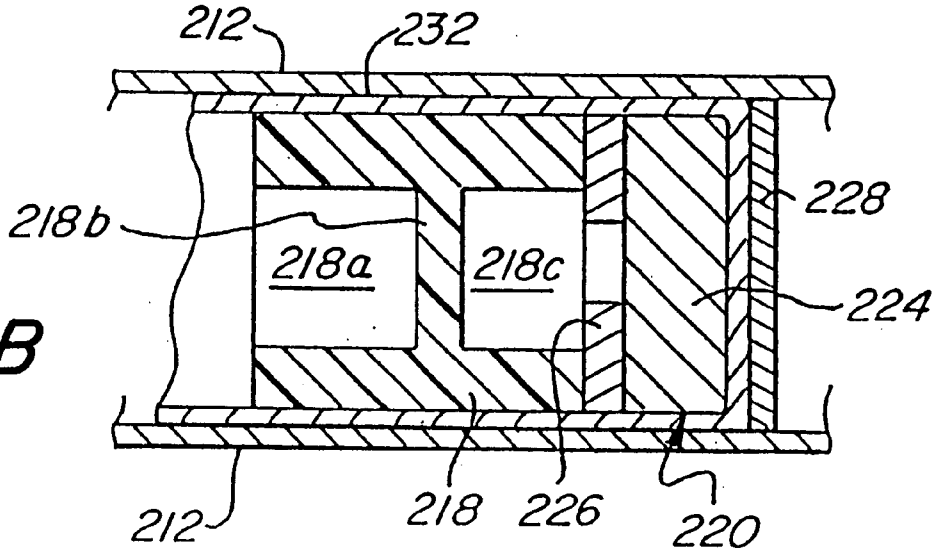
FIG. 6B is a view, enlarged relative to FIG. 6A, of the isolation cup and booster charge components of the detonator of FIG. 6A.

Isolation cup 218 has a friction fit inside housing 212 and is made of a semiconductive material, e.g., a carbon-filled polymeric material, so that it forms a conductive grounding path from shock tube 210 to housing 212 to dissipate any static electricity which may travel along shock tube 210. Such isolation cups are well-known in the art. See, e.g., U.S. Pat. No. 3,981,240 to Gladden, issued Sep. 21, 1976. A low-energy booster charge 220 is positioned adjacent to anti-static isolation cup 218. As best seen in FIG. 6B, anti-static isolation cup 218 comprises, as is well-known in the art, a generally cylindrical body (which is usually in the form of a truncated cone, with the larger diameter end disposed towards the open end 212*a* of housing 212) which is divided by a thin, rupturable membrane 218*b* into an entry chamber 218*a* and an exit chamber 218*c*. The end 210*b* of shock tube 210 (FIG. 6A) is received within entry chamber 218*a* (shock tube 210 is not shown in FIG. 6B for clarity of illustration). Exit chamber 218*c* provides an air space or stand-off-between the end 210*b* of shock tube 210 and booster charge 220 which are disposed in mutual signal transfer relation to each other. In operation, the shock wave signal emitted from end 210*b* of shock tube 210 will rupture membrane 218*b*, traverse the stand-off provided by exit chamber 218*c* and initiate booster charge 220.

Booster charge 220 comprises a small quantity of a primary explosive 224 such as lead azide (or a suitable secondary explosive material such as BNCP), which is disposed within a booster shell 232 and upon which is disposed a first cushion element 226 (not shown in FIG. 6A for ease of illustration). First cushion element 226, which is annular in configuration except for a thin central membrane, is located between isolation cup 218 and explosive 224, and serves to protect explosive 224 from pressure imposed upon it during manufacture.

Isolation cup 218, first cushion element 226, and booster charge 220 may conveniently be fitted into a booster shell 232 as shown in FIG. 6B. The outer surface of isolation cup 218 is in conductive contact with the inner surface of booster shell 232 which in turn is in conductive contact with housing 212 to provide an electrical current path for any static electricity discharged from shock tube 210. Generally, booster shell 232 is inserted into housing 212 and housing 212 is crimped to retain booster shell 232 therein as well as to protect the contents of housing 212 from the environment.

A non-conductive buffer 228 (not shown in FIG. 6A for ease of illustration), which is typically 0.015 inch thick, is located between booster charge 220 and transducer module 158 to electrically isolate transducer module 158 from booster charge 220. Transducer module 158 comprises a piezoelectric transducer (not shown in FIG. 6A) that is disposed in force-communicating relationship with booster charge 220 and so can convert the output force of booster charge 220 to a pulse of electrical energy. Transducer module 158 is operatively connected to electronics module 154 as shown in FIG. 5. The initiation signal transmission means comprising shock tube segment 210*a*, booster charge 220 and transducer module 158 serves to deliver to delay circuit 10, in electrical form, a non-electric initiation signal received via shock tube 210, as described below.

The enclosure for the initiation and output charges provided by detonator 200 comprises, in addition to housing 212, the optional open-ended steel sleeve 121 that encloses electronics module 154. Electronics module 154 comprises at its output end an output initiation element 146 (shown in FIG. 5), which comprises part of the out-put means for the detonator. Adjacent to the initiation element of electronics module 154 is a second cushion element 242, which is similar to first cushion element 226. Second cushion element 242 separates the output end of electronics module 154 from the remainder of the detonator output means, comprising an output charge 244 that is pressed into the closed end 212*b* of housing 212. Output charge 244 comprises a secondary explosive 244*b* that is sensitive to the initiation element of electronics module 154 and that has sufficient shock power to detonate cast booster explosives, dynamite, etc. Output charge 244 may optionally comprise a relatively small charge of a primary explosive 244*a* for initiating secondary explosive 244*b*, but primary explosive 244*a* may be omitted if the initiation charge of electronics module 154 has sufficient output strength to initiate secondary explosive 244*b*. The secondary explosive 244*b* has sufficient shock power to rupture housing 212 and detonate cast booster explosives, dynamite, etc., disposed in signal transfer proximity to detonator 200. The out-put means for the detonator comprises those components, including reactive materials, e.g., explosives, that are initiated by the discharge of the storage means to the output terminal. Thus, in the embodiment illustrated in FIGS. 5, 6A and 6B, the detonator output means comprises the initiation element 146, initiation charge 146*a* and output charge 244.

In use, a non-electric initiation signal traveling through shock tube 210 is emitted at end 210*b*. The signal ruptures membrane 218*b* of isolation cup 218 and first cushion element 226 to activate booster charge 220 by initiating primary explosive 224. Primary explosive 224 generates a detonation shock wave that imposes an output force on the piezoelectric generator in transducer module 158. The piezoelectric generator is in force-communicating relationship with booster charge 220 and so converts the output force to an electrical output signal in the form of a pulse of electrical energy that is received by electronics module 154. As indicated above, electronics module 154 stores the pulse of electric energy and, after a predetermined delay, releases or conveys the energy to the detonator output means. In the illustrated embodiment, the charge is released to the initiation element, which initiates output charge 244. Output charge 244 ruptures housing 212 and emits an explosive output signal that can be used to initiate other explosive devices, as is well-known in the art.

While the invention has been described in detail with reference to a particular embodiment thereof, it will be apparent that upon a reading and understanding of the foregoing, numerous alterations to the described embodiment will occur to those skilled in the art and it is intended to include such alterations within the scope of the appended claims.

What is claimed is:

1. An oscillator circuit for generating a clock signal comprising a series of clock pulses, the circuit comprising:

(a) a reference voltage means for producing a reference voltage;

(b) at least two capacitors, each capacitor having one of a charged state and a discharged state relative to the reference voltage, a capacitor in the discharged state having a voltage less than the reference voltage and being designated a discharged capacitor, and a capacitor in the charged state having a voltage that exceeds the reference voltage and being designated a charged capacitor;

(c) a charging means for charging a discharged capacitor to a charged state;

(d) a discharging means for discharging a charged capacitor, designated a charged working capacitor, to a discharged state;

(e) a comparator for generating an internal signal each time a charged working capacitor becomes a discharged capacitor;

(f) switching means for performing a switching function comprising effectively disconnecting a discharged capacitor from the discharging means and connecting the discharged capacitor to the charging means, and for effectively disconnecting a charged capacitor from the charging means and connecting the charged capacitor to the discharging means; and (g) a latch for issuing a clock pulse in response to the internal signals;

wherein the switching means also connects the at least two capacitors to the same comparator.

2. The oscillator circuit of claim 1 wherein the switching means is responsive to the latch for performing the switching function in response to clock pulses issued by the latch.

3. An oscillator circuit for generating a clock signal comprising a series of clock pulses, the circuit comprising:

(a) a reference voltage means for producing a reference voltage;

(b) at least two capacitors, each capacitor having one of a charged state and a discharged state relative to the reference voltage, a capacitor in the discharged state having a voltage less than the reference voltage and being designated a discharged capacitor, and a capacitor in the charged state having a voltage that exceeds the reference voltage and being designated a charged capacitor;

(c) a charging means for charging a discharged capacitor to a charged state;

(d) a discharging means for discharging a charged capacitor, designated a charged working capacitor, to a discharged state;

(e) a comparator for generating an internal signal each time a charged working capacitor becomes a discharged capacitor;

(f) switching means for performing a switching function comprising effectively disconnecting a discharged capacitor from the discharging means and connecting the discharged capacitor to the charging means, and for effectively disconnecting a charged capacitor from the charging means and connecting the charged capacitor to the discharging means; and (g) a latch for issuing a clock pulse in response to the internal signals;

wherein the discharge means comprises a resistor through which the capacitors are discharged.

4. The oscillator circuit of claim 3 wherein the switching means is responsive to the latch for performing the switching function in response to clock pulses issued by the latch.

5. The oscillator circuit of claim 3 wherein the charging means comprises a constant voltage source.

6. An oscillator circuit for generating a clock signal comprising a series of clock pulses, the circuit comprising:

(a) a reference voltage means for producing a reference voltage;

(b) at least two capacitors, each capacitor having one of a charged state and a discharged state relative to the reference voltage, a capacitor in the discharged state having a voltage less than the reference voltage and being designated a discharged capacitor, and a capacitor in the charged state having a voltage that exceeds the reference voltage and being designated a charged capacitor;

(c) a charging means for charging a discharged capacitor to a charged state;

(d) a discharging means for discharging a charged capacitor, designated a charged working capacitor, to a discharged state;

(e) a comparator for generating an internal signal each time a charged working capacitor becomes a discharged capacitor;

(f) switching means for performing a switching function comprising effectively disconnecting a discharged capacitor from the discharging means and connecting the discharged capacitor to the charging means, and for effectively disconnecting a charged capacitor from the charging means and connecting the charged capacitor to the discharging means; and (g) a latch for issuing a clock pulse in response to the internal signals;

wherein the charging means comprises a constant voltage source.

7. The oscillator circuit of claim 6 wherein the switching means is responsive to the latch for performing the switching function in response to clock pulses issued by the latch.

* * * * *

UNITED STATES PATENT AND TRADEMARK OFFICE

CERTIFICATE OF CORRECTION

PATENT NO. : 6,268,775 B1
DATED : July 31, 2001
INVENTOR(S) : Patti

It is certified that error appears in the above-identified patent and that said Letters Patent is hereby corrected as shown below:

Column 1,
Line 42, replace “perrnanently” with -- permanently --;

Column 8,
Line 36, replace “PROGO” with -- PROGP --;

Column 14,
Line 10, replace “112” with -- I12 --.

Signed and Sealed this

Eleventh Day of November, 2003

JAMES E. ROGAN
*Director of the United States Patent and Trademark Office*